US010450171B1

(12) United States Patent
Phillips

(10) Patent No.: US 10,450,171 B1
(45) **Date of Patent: *Oct. 22, 2019**

(54) AUTOMATIC DE-RATE OPERATING SYSTEM AND METHOD FOR A TRUCK MOUNTED CRANE

(71) Applicant: Auto Crane Company, Tulsa, OK (US)

(72) Inventor: Ian R. Phillips, Tulsa, OK (US)

(73) Assignee: Auto Crane Company, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/132,581

(22) Filed: Sep. 17, 2018

Related U.S. Application Data

(63) Continuation of application No. 14/691,729, filed on Apr. 21, 2015, now Pat. No. 10,077,174.

(51) Int. Cl.

| | |
|---|---|
| ***B66C 23/88*** | (2006.01) |
| ***B66C 23/44*** | (2006.01) |
| ***B66C 13/18*** | (2006.01) |

(52) U.S. Cl.
CPC ..... *B66C 23/88* (2013.01); *B66C 13/18* (2013.01); *B66C 23/44* (2013.01)

(58) Field of Classification Search
CPC ..... B66C 23/905; B66C 23/78; B66C 23/88
See application file for complete search history.

(56) References Cited

U.S. PATENT DOCUMENTS

| | | | | |
|---|---|---|---|---|
| 4,063,649 A | | 12/1977 | Hubbard et al. | |
| 4,064,997 A | | 12/1977 | Holland et al. | |
| 4,178,591 A | | 12/1979 | Geppert | |
| 4,216,868 A | | 8/1980 | Geppert | |
| 5,217,126 A | * | 6/1993 | Hayashi | B66C 23/905 212/277 |
| 5,711,440 A | * | 1/1998 | Wada | B66C 23/905 212/231 |
| 5,730,305 A | * | 3/1998 | Ichiba | B66C 23/905 212/276 |
| 5,823,370 A | * | 10/1998 | Ueda | B66C 23/905 212/276 |
| 6,208,260 B1 | | 3/2001 | West et al. | |
| 6,894,621 B2 | | 5/2005 | Shaw | |
| 8,862,337 B2 | | 10/2014 | Peters et al. | |

(Continued)

FOREIGN PATENT DOCUMENTS

| | | |
|---|---|---|
| DE | 4447393 C1 | 6/1996 |
| GB | 2493946 A | 2/2013 |
| WO | 20141388801 A1 | 9/2014 |

OTHER PUBLICATIONS

Manitowac, "Manitowac, Model 22101s Product Guide, 2001".

*Primary Examiner* — Thomas Ingram
(74) *Attorney, Agent, or Firm* — GableGotwals

(57) ABSTRACT

A crane control system and method which automatically de-rates the maximum capacity of the crane when the boom is located in a first zone located on one side of the truck or in a second zone located on the opposite side of the truck. The control system de-rates the crane without input from the crane operator. The control system may use an inductive proximity sensor located on the base of the boom to locate stationary steel targets located around the base of the boom. The targets approximate the outer ranges of the first and second zones.

20 Claims, 7 Drawing Sheets

(56) References Cited

U.S. PATENT DOCUMENTS

| | | | | |
|---|---|---|---|---|
| 2012/0065840 | A1* | 3/2012 | Reeb | B66C 23/905 701/36 |
| 2013/0001183 | A1 | 1/2013 | Wierzba et al. | |
| 2013/0013144 | A1* | 1/2013 | Tanizumi | B66C 23/905 701/34.4 |
| 2014/0032060 | A1* | 1/2014 | Zinke | B66C 23/78 701/50 |
| 2014/0076836 | A1 | 3/2014 | Qi et al. | |
| 2014/0116975 | A1* | 5/2014 | Benton | B66C 23/88 212/302 |

* cited by examiner

AUTOMATIC DE-RATE OPERATING SYSTEM AND METHOD FOR A TRUCK MOUNTED CRANE

CROSS REFERENCE TO PENDING APPLICATION

This application is a continuation of U.S. patent application Ser. No. 14/691,729 filed Apr. 21, 2015, which is incorporated herein by reference.

FIELD OF THE INVENTION

The present invention relates generally to an operating system for a truck mounted crane. More particularly, the present invention relates to a truck mounted crane operating system that de-rates the lifting capacity of the crane based on the rotational location of the boom.

BACKGROUND OF THE INVENTION

Small cranes are commonly found on service trucks used by utility companies, construction companies, and tradesmen. These cranes can be used to lift any number of heavy objects in the field. When a lift is carried out, the operator does not know the weight of the object being lifted. Many times the operator's estimate of the objects weight can be off significantly. This can lead to the operator causing the crane to become unstable and possibly rolling the crane and truck. These cranes typically have a boom mounted to a rotatable base.

One of the most common hazards of operating a crane is lifting too large of a load. Often times it is not the actual weight of the load being lifted that causes accidents, it is that the load being lifted along the side of the truck. When this occurs, the truck becomes unstable. In extreme cases the truck can overturn.

While accidents like this occur regularly, prior attempts to implement safeguards have been limited to crane operating systems which monitor the weight of the load or hydraulic system pressure created by the load. This is a key variable in the problem. However, what begins as a lift, which is well within the capacity of the crane, can have devastating results when the load is moved alongside the truck. The same sized load may be safely lifted if it is towards the rear of the truck.

Therefore, what is needed is a crane operating system which prevents lifting dangerous loads alongside the truck.

Further, what is needed is a crane operating system which automatically prevents such dangerous lifts without additional input from the operator in normal operating mode.

BRIEF SUMMARY OF THE INVENTION

The present invention achieves its objections by providing a crane control system and method which automatically de-rates the maximum capacity of the crane when the boom is located in a first zone located on one side of the truck or in a second zone located on the opposite side of the truck. The control system de-rates the crane without input from the crane operator. The control system uses an inductive proximity sensor located on the base of the crane to locate stationary steel targets located around the base of the crane. The targets approximate the outer ranges of the first and second zones.

The present invention prevents dangerous lifts alongside the truck. This reduces the likelihood of dangerous rollover accidents.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
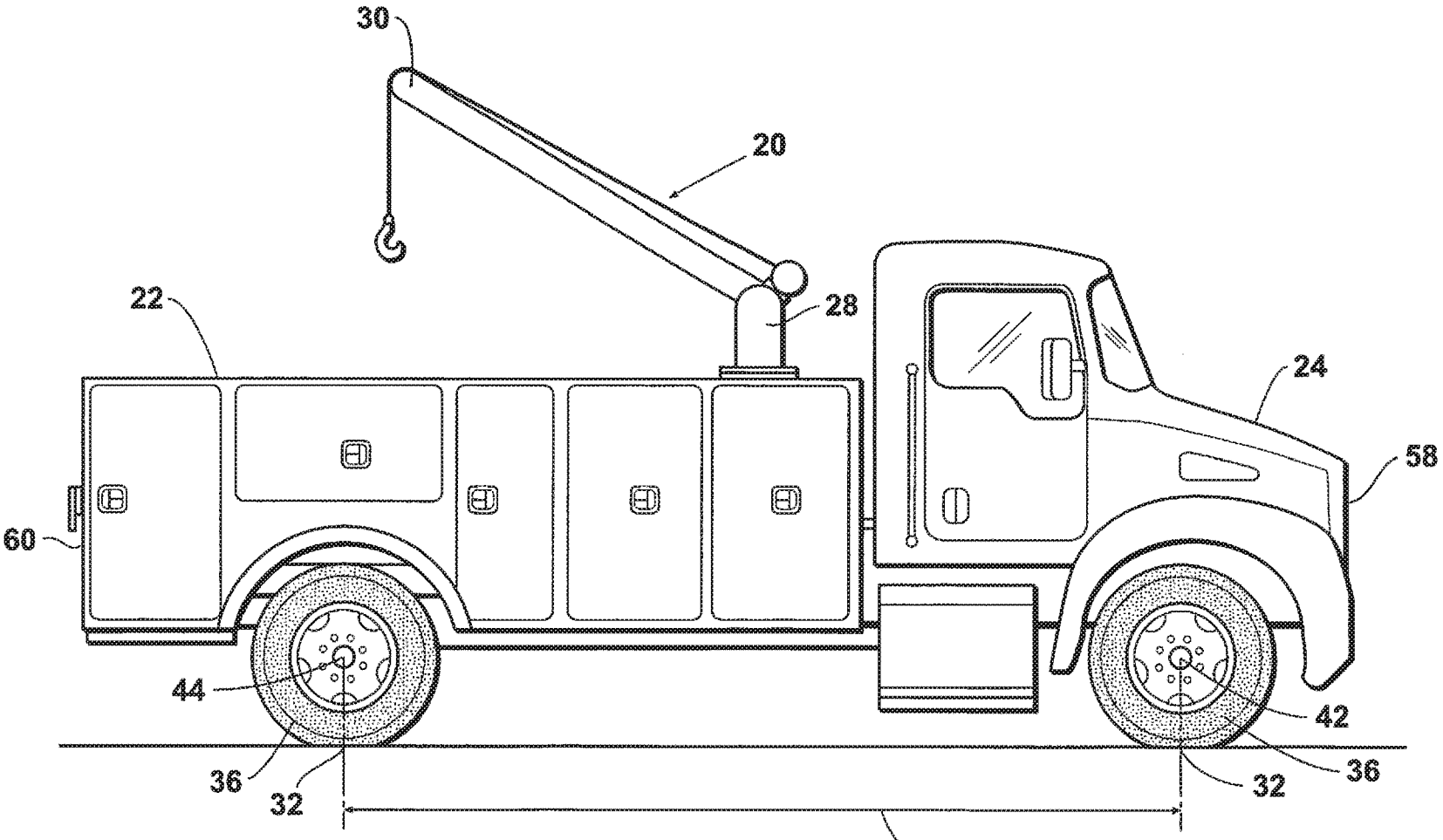
FIG. 1 is a side view of a truck mounted crane.
Figure 2:
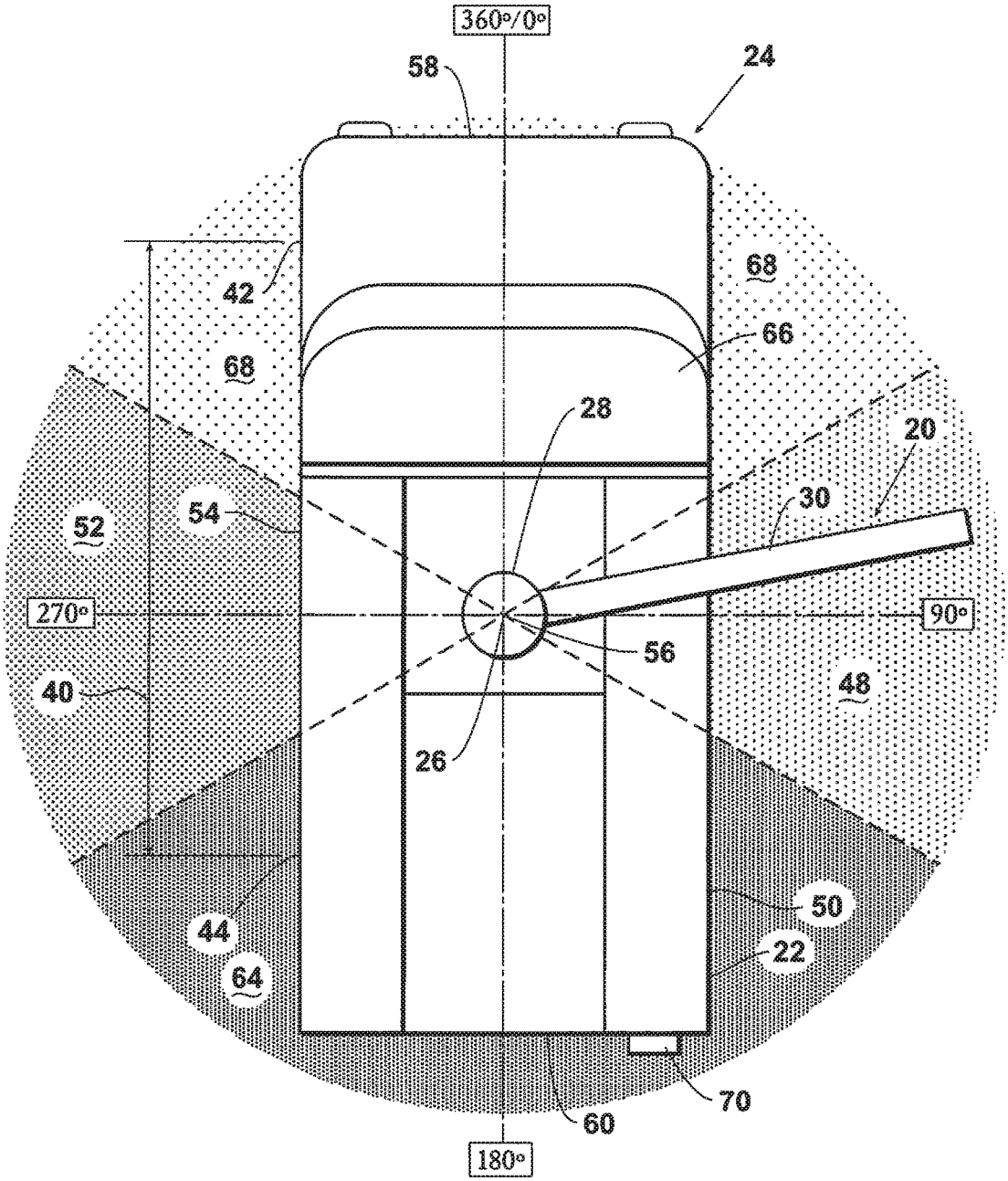
FIG. 2 is a top view of a truck mounted crane.
Figure 3:
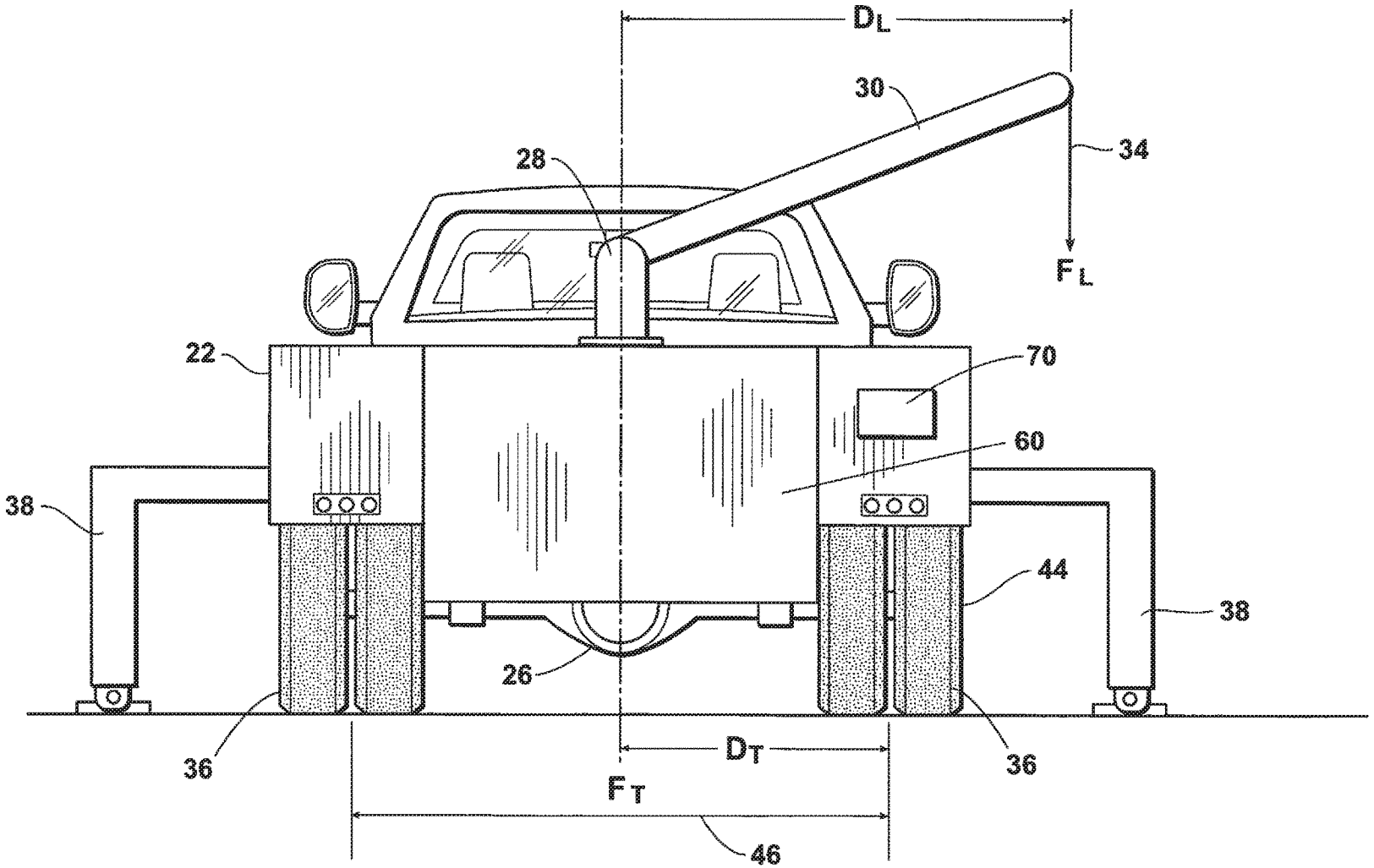
FIG. 3 is a rear view of a truck mounted crane.

Turning now to the drawings, wherein like reference characters indicate like or similar parts throughout, FIG. 1 shows a crane 20 mounted on a truck service body 22. FIG. 2 is a top view of the truck 24, service body 22 and crane 20. Generally speaking, rollover accidents occur when the moment of the lift (ML) exceeds the moment of the center of gravity of the truck (MT). The moment of the lift is calculated by multiplying the weight of the lift (FL) by the horizontal distance (DL) between the lift and the base 28 of the crane 20. The moment of the center of gravity of the truck (MT) is calculated by multiplying the weight of the truck (FT) by the horizontal distance (DT) between the truck's 24 point of contact 32 located between the boom 30 and the lift 34. The truck's 24 point of contact 32 will typically be a wheel 36 or outrigger 38.

Because the wheel base 40 of a truck 24, i.e. the distance between the front axle 42 and the rear axle 44, is generally longer than the track 46 of the truck 24, i.e. the distance between the wheels 36 on the same axle 42 or 44, the risk of a rollover accident during a lift is more likely to occur on either side of the truck 24.

There is a first zone 48 on the first side 50 and a second zone 52 located on the second side 54 of the truck 24. As best seen in FIG. 2, the zones 48 and 52 are located based on their radial location about the center 56 of the truck 24. The front 58 is 0° and 360°. The rear 60 of the truck 24 is 180°. The first and second zones 48 and 52 are defined as a range of degrees. The first zone 48 may extend from 45° to 135° about the center 56 of the truck 24. Other embodiments may narrow the first zone 48 down to 60° to 120° about the center 56 of the truck 24. The first zone 48 may also be varied to any range between these two examples. The second zone 52 may extend from 225° to 315° about the center 56 of the truck 24. Other embodiments may narrow the second zone 52 down to 240° to 300° about the center 56 of the truck 24. The second zone 52 may also be varied to any range between these two examples.

According to the present invention, the crane controller 70 determines the rotational location of the boom 30. If the boom is located in either the first or second zones 48 and 52 the maximum lift capacity is reduced by a predetermined percentage. The reduction in maximum lift could be any number within the range of 10% to 50%. The amount of reduction is dependent upon the geometry of the truck 24

(such as wheel base 40, and track 46) and location of the crane 20 on the service body 22 or truck 24.

The amount of reduction of maximum lift is a predetermined amount set at the time the crane controller 70 is installed in the crane 20. Further, the de-rate occurs automatically by the crane controller 70 without any input from the crane operator.

The base 28 of the crane 20 may not be located on the center of 56 of the truck 24. Thus the crane 20 may be able to safely lift more weight on one side of the truck 24 than on the other side of the truck 24. Thus, the present invention may have embodiments where the amount of reduction of maximum capacity is different in the first zone 48 than it is in the second zone 52.

Figure 4:
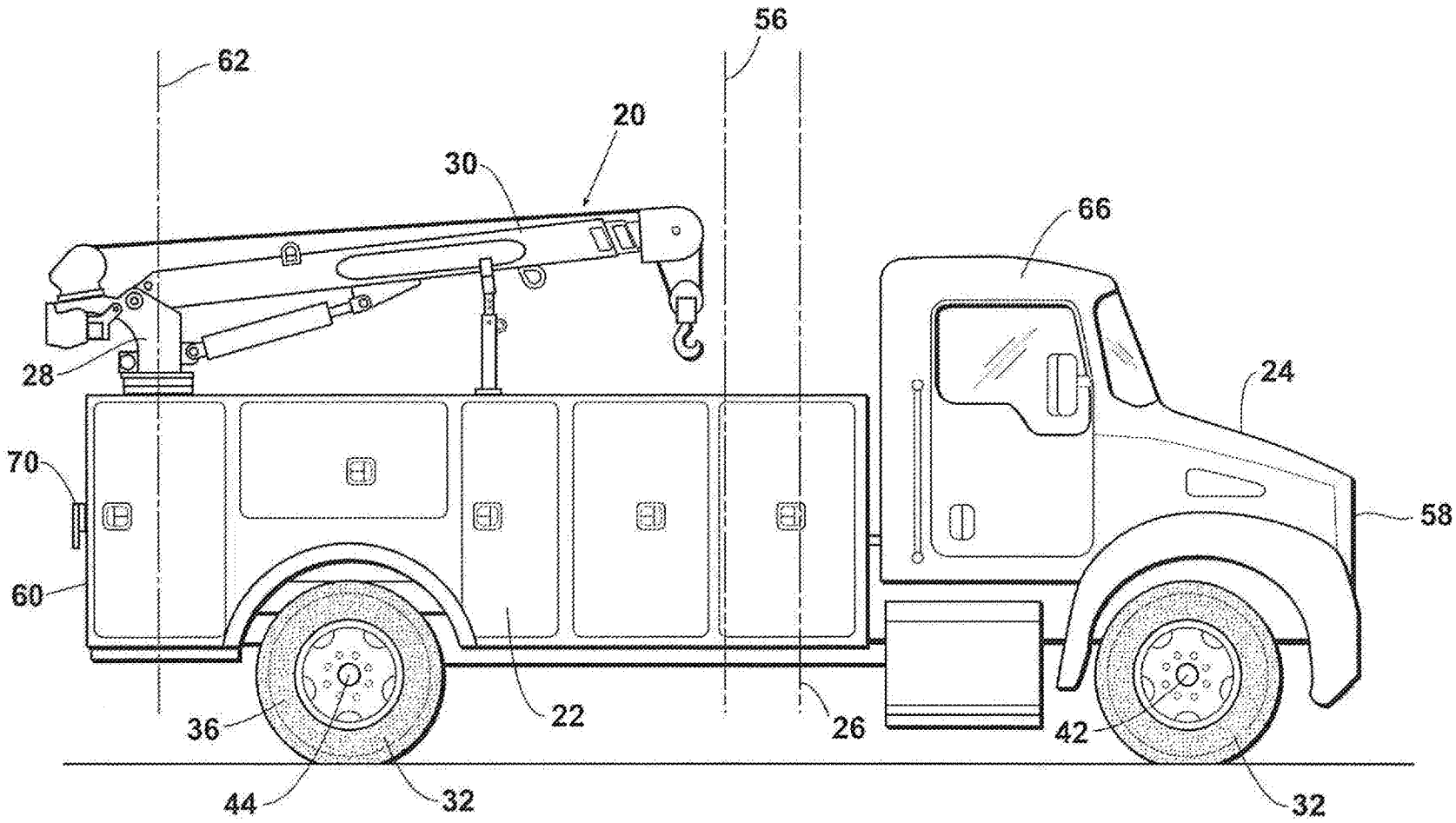
FIG. 4 is a side view of a truck with a crane mounted at the back of the service body.
Figure 5:
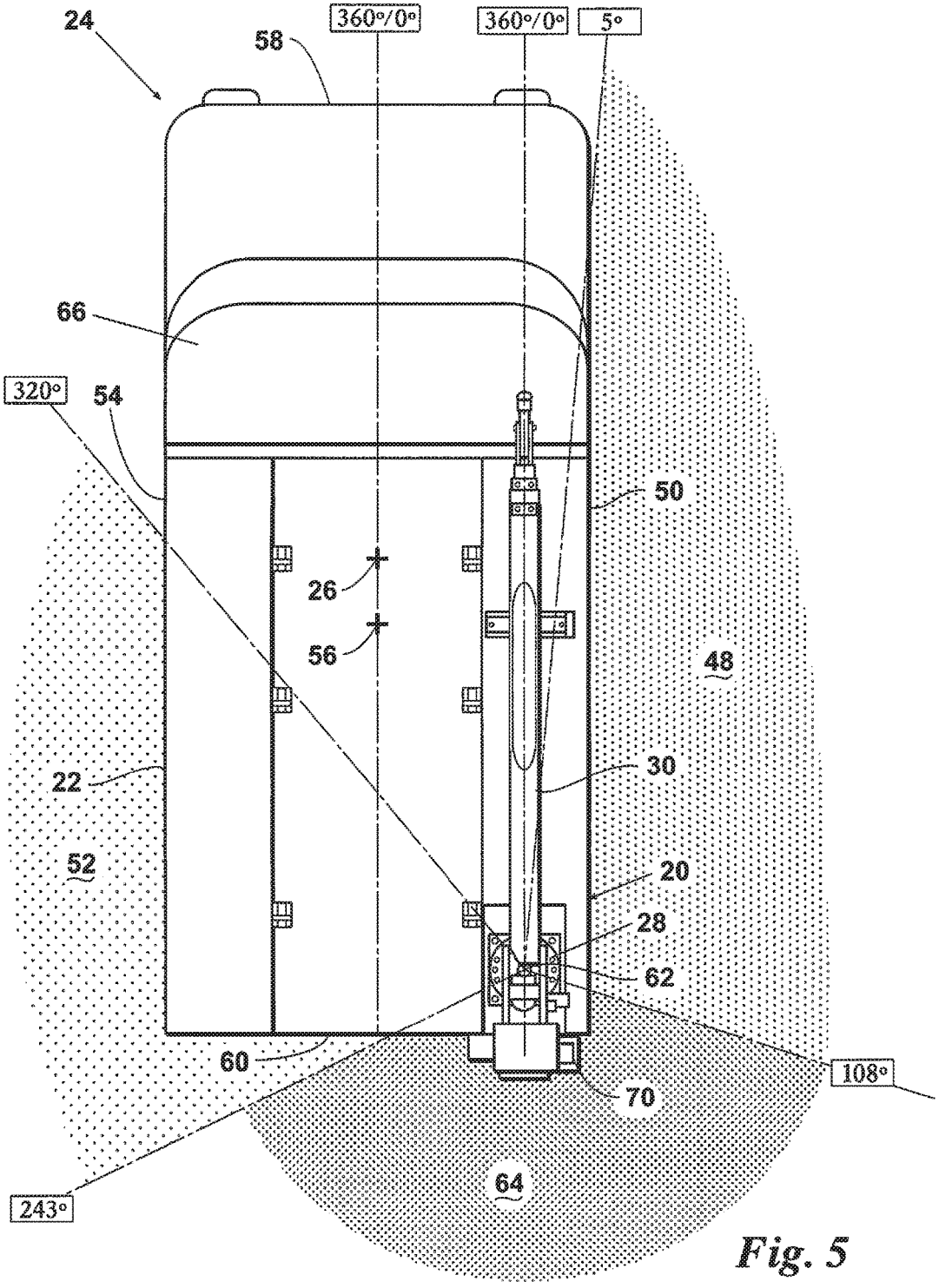
FIG. 5 is a top view of the truck in FIG. 4.

FIGS. 4 and 5 show the present invention where the axis of rotation 62 of the crane 20 is not aligned with the center 56 of the truck 24. Here, the crane 20 is located on the rear passenger side (first side 50) and rear 60 of the truck 24. The location of the first and second zone 48 and 52 are still located on either side of the truck 24. However, angle of the boom 30 about its axis of rotation 62 is different in order to align with the first and second zone 48 and 52 as defined earlier about the center 56 of the truck 24. Thus the angles defining these zones must be translated when the axis of rotation 62 of the crane 10 is moved. Here, the first zone 48 runs from 5° to 108° approximately relative to the axis of rotation 62 of the crane 20. The second zone 52 runs from 243° to 320° approximately relative to the axis of rotation 62 of the crane 20. The full power zone 64 at the rear 60 of the truck 24 runs from 108° to 243° approximately relative to the axis of rotation 62 of the crane 20. Government regulations generally prohibit lifting when the boom 30 is over the cab 66 of the truck 24. Thus, there is a no lift zone 68 from 320° to 5° approximately relative to the axis of rotation 62 of the crane 20. In the preferred embodiment, the restriction of lifting over the cab 66 is carried out through the actions of the operator. However, additional restrictions may be programmed into the crane control 70.

In comparing FIGS. 2 and 5 it can be understood that location of the crane 20 on the service body 22 impacts the exact location of the first and second zones 48 and 52 relative to the axis of rotation 62 of the crane. Further, the length and width of the truck 24 and/or service body 22 also impacts the exact location of the first and second zones 48 and 52 relative to the axis of rotation 62 of the crane 20. This means when the axis of rotation 62 of the crane 20 is not located in the center 56 of the truck 24, the angles identifying the first and second zones 48 and 52 must be translated for reference about the axis of rotation 62 in this "off center" location. This translation is accomplished using basic geometry.

Figure 6:
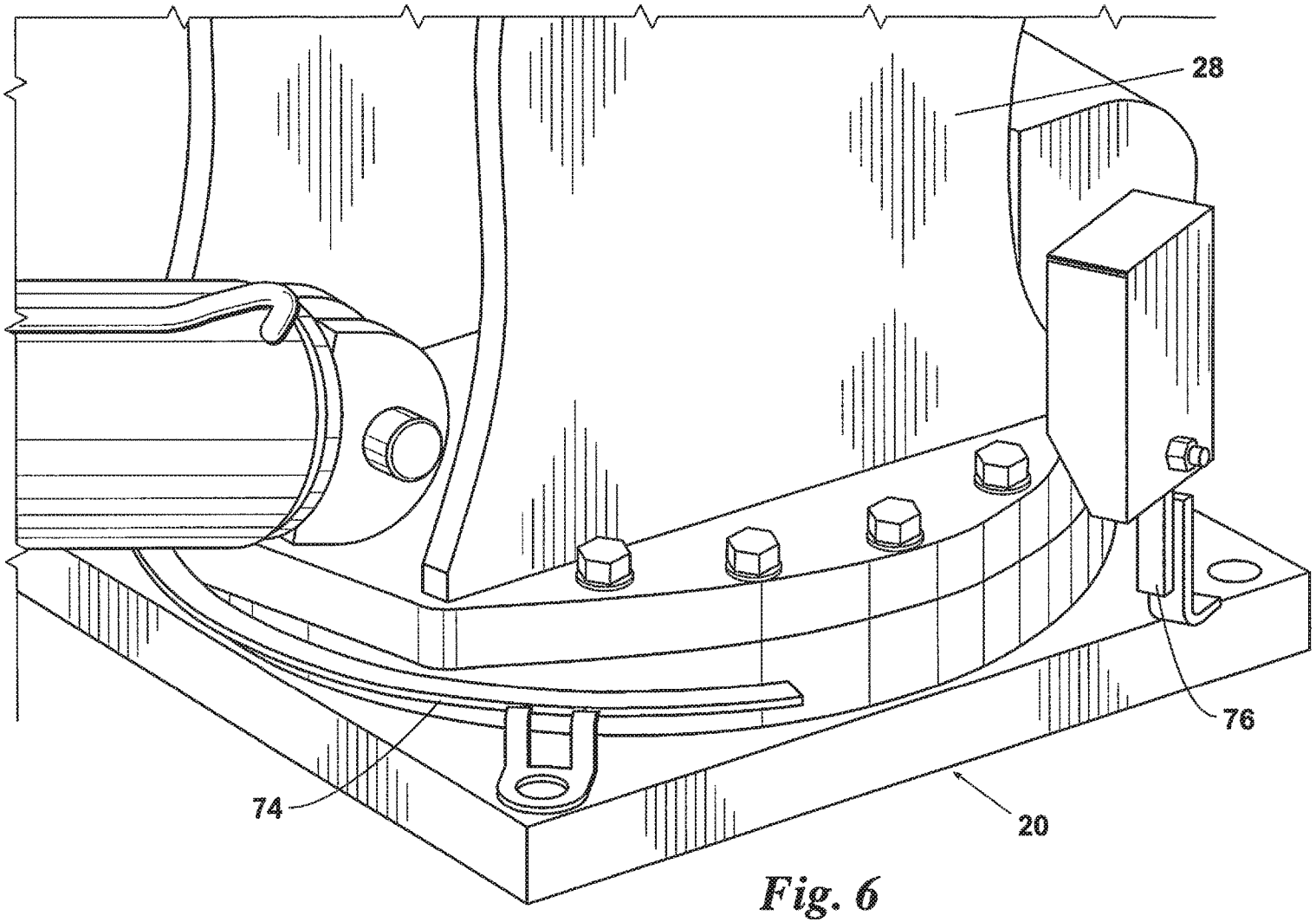
FIG. 6 is a perspective view of the base of the crane showing the arrangement of sensors and target.
Figure 7:
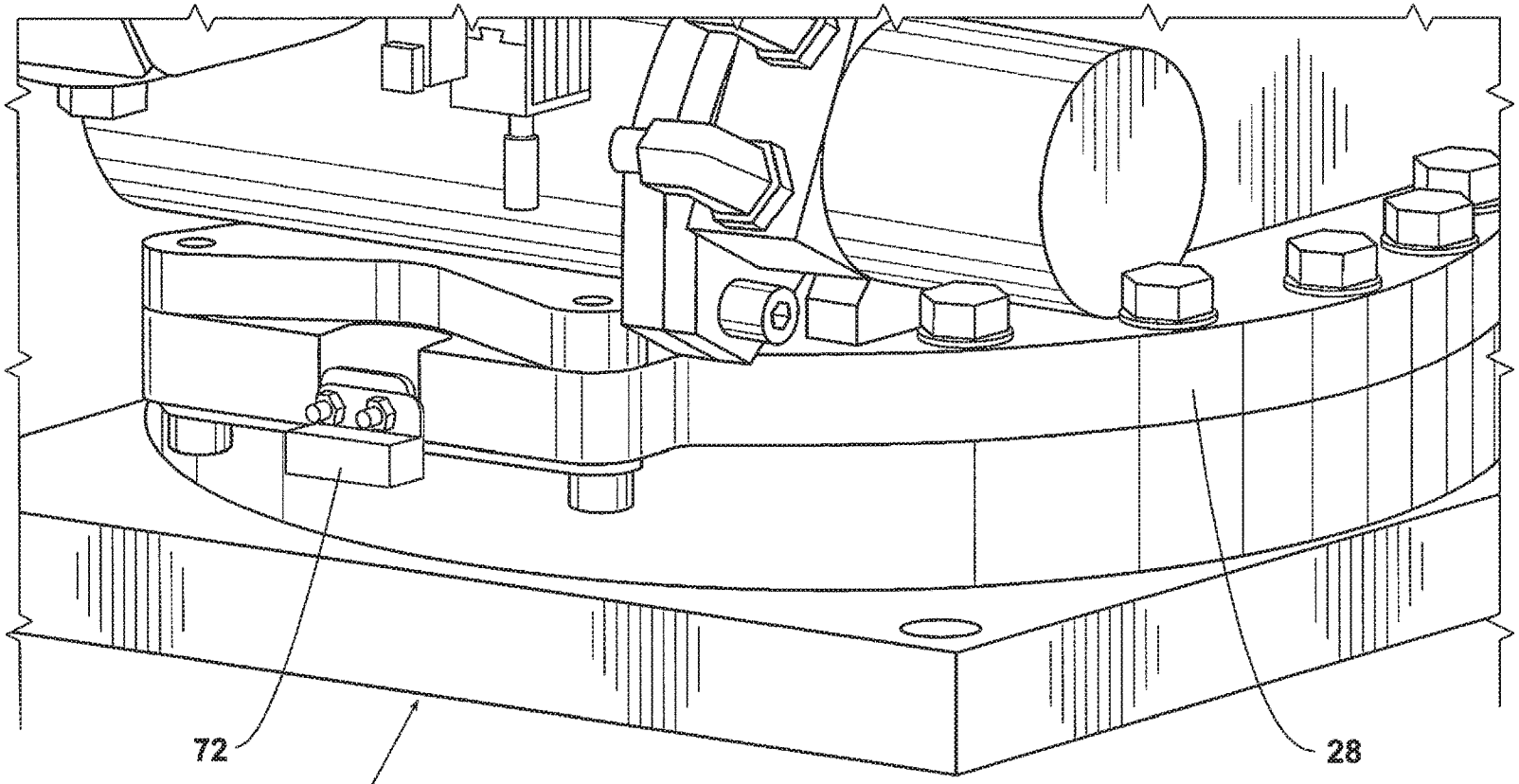
FIG. 7 is a perspective view showing the arrangement of the sensor on the base of the crane.

In the preferred embodiment of the present invention shown in FIGS. 4-6 the boom 30 of the crane 20 is fitted with an inductive proximity sensor 72. The inductive proximity sensor 72 rotates with the boom 30. One or more stationary steel targets 74 are located around the base 28 of the boom 30. The targets 74 are located to approximate when the boom is not located in either the first or second zone 48 and 52. Thus when the proximity sensor 72 senses that it is over the target 74 the crane has full power. When the sensor 72 does not detect the target 74 the power to the crane is reduced or de-rated by approximately 25% as explained above. A safety stop 76 prevents the crane 20 from rotating more than 360°.

In this example, the first and second zones 48 and 52 are combined with the no lift zone 68 over the cab 66. This means the maximum lift of the crane 20 is reduced from 225° to 135° about the center 56 of the truck 24. This translates into approximately 243° to 108° about the axis of rotation 62 of the crane 20.

As the boom 30 rotates about its axis of rotation, 30 the one or more targets 74 come into and out of range of the proximity sensor 72. The signal from the proximity sensor 72 is fed to the crane controller 70. The crane controller 70—which includes a microprocessor with computer executable instructions stored on non-transitory computer readable medium—can then determine whether the boom 30 is within the first or second zone 48 and 52 and whether the maximum capacity of the crane 20 should be reduced. If the boom 30 is within the first or second zone 48 or 52, the maximum capacity of the crane 20 is reduced by the predetermined percentage.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A crane mountable on a service body of a truck, the crane comprising:

targets located about a base of the crane to approximate rotational outer ranges of a reduced lift zone of the crane;

a crane controller in communication with the crane, the crane controller including:

a sensor configured to detect the targets during a rotation of the crane; and a microprocessor with a set of computer executable instructions stored on non-transitory computer readable medium, the microprocessor configured to receive a target detection signal from the sensor and send a stop rotation signal to the crane;

wherein the crane is prevented from rotating into the reduced lift zone.

2. The crane of claim 1 wherein the reduced lift zone is located from 60° to 120° about the center of the truck.

3. The crane of claim 1 wherein the reduced lift zone is located from 240° to 300° about the center of the truck.

4. The crane of claim 1 wherein the reduced lift zone is located from 45° to 135° about the center of the truck.

5. The crane of claim 1 wherein the reduced lift zone is located from 225° to 315° about the center of the truck.

6. The crane of claim 1 wherein the reduced lift zone is a zone in which a maximum load of the crane is de-rated in a range of 10% to 50%.

7. The crane of claim 1 wherein the reduced lift zone is a zone in which a maximum load of the crane is de-rated in a range of 10% to 25%.

8. The crane of claim 1 wherein the reduced lift zone is a zone in which a maximum load of the crane is de-rated in a range of 25% to 50%.

9. The crane of claim 1 further comprising:

the crane including an axis of rotation of the crane;

the axis of rotation of the crane does not pass through a center of the truck.

10. The crane of claim 1 further comprising the targets being metal targets.

11. The crane of claim 1, further comprising the sensor being an inductive proximity sensor.

12. A method for preventing a truck mounted crane from rotating into a reduced lift zone, the method being executed by a set of computer executable instructions stored on computer readable medium and executed by a microprocessor of a crane controller in communication with a sensor and a crane power source, the method comprising:

detecting, by way of the sensor, a rotational location of the crane relative to targets-defining outer ranges of a reduced lift zone;

sending a target detection signal from the sensor to the microprocessor; and the microprocessor receiving the target detection signal and sending a stop rotation signal to the crane controller;

wherein the crane is prevented from rotating into the reduced lift zone.

13. The method of claim 12 wherein the reduced lift zone is located from 60° to 120° about the center of the truck.

14. The method of claim 12 wherein the reduced lift zone is located from 240° to 300° about the center of the truck.

15. The method of claim 12 wherein the reduced lift zone is located from 45° to 135° about the center of the truck.

16. The method of claim 12 wherein the reduced lift zone is located from 225° to 315° about the center of the truck.

17. The method of claim 12 wherein the reduced lift zone is a zone in which a maximum load of the crane is de-rated in a range of 10% to 50%.

18. The method of claim 12 wherein the reduced lift zone is a zone in which a maximum load of the crane is de-rated in a range of 10% to 25%.

19. The method of claim 12 wherein the reduced lift zone is a zone in which a maximum load of the crane is de-rated in a range of 25% to 50%.

20. A method for preventing a truck mounted crane from rotating into a reduced lift zone, the method being executed by a set of computer executable instructions stored on computer readable medium and executed by a microprocessor of a crane controller in communication with a sensor and a crane power source, the method comprising:

detecting, by way of the sensor, a rotational location of the crane relative to an outer range of a reduced lifting zone;

sending a rotational location signal from the sensor to the microprocessor;

the microprocessor receiving the rotational location signal and sending a stop rotation signal to the crane controller;

wherein the crane is prevented from rotating into the predetermined reduced lift zone.

* * * * *